US005218785A

United States Patent [19]

Hall

[11] Patent Number: 5,218,785

[45] Date of Patent: Jun. 15, 1993

[54] APPARATUS FOR FINISHING A CONIC SURFACE

[75] Inventor: Howard D. Hall, Newtown, Conn.

[73] Assignee: Hughes Aircraft Company, Los Angeles, Calif.

[21] Appl. No.: 892,917

[22] Filed: Jun. 3, 1992

Related U.S. Application Data

[63] Continuation of Ser. No. 698,422, May 10, 1991.

[51] Int. Cl.[5] ..... B24D 17/00

[52] U.S. Cl. ..... 51/57; 51/290; 51/363

[58] Field of Search ..... 51/57, 67, 165.93, 284, 51/290, 363, 391, 392

[56] References Cited

U.S. PATENT DOCUMENTS

| | | | |
|---|---|---|---|
| 965,144 | 7/1910 | Hyer | 51/58 |
| 1,839,557 | 1/1932 | Hilwig | 51/389 |
| 3,835,587 | 9/1974 | Hall, Jr. | 51/290 |
| 4,512,107 | 4/1985 | Jones | 51/56 R |
| 4,823,515 | 4/1989 | Blome | 51/363 |

*Primary Examiner*—Bruce M. Kisliuk
*Assistant Examiner*—Bo Bounkong
*Attorney, Agent, or Firm*—Michael W. Sales; Wanda Denson-Low

[57] ABSTRACT

The apparatus for finishing the conic surface includes a flexible base member and rigid side members, which rigid side members are secured such that the planes thereof intersect in a line that is collinear with the axis of the conic surface to be finished.

12 Claims, 2 Drawing Sheets

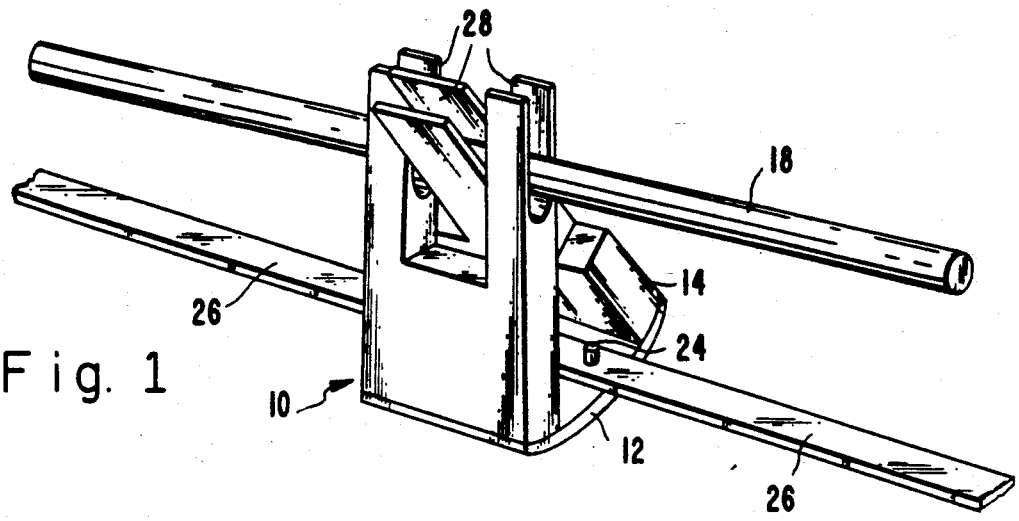
Fig. 1
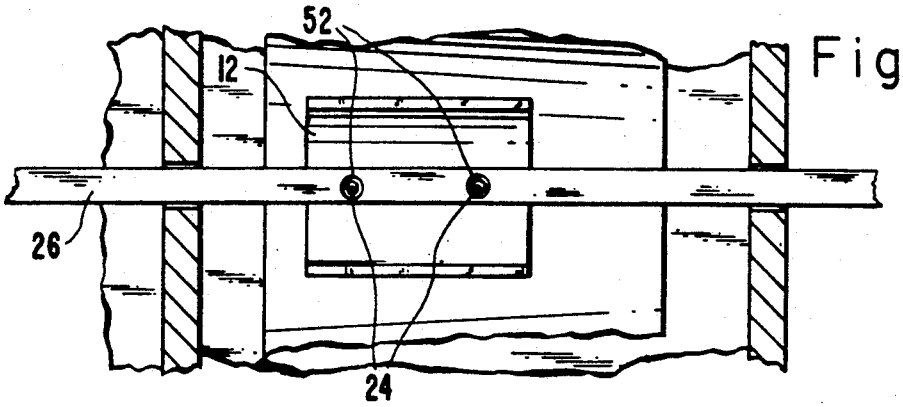
Fig. 4
Fig. 3
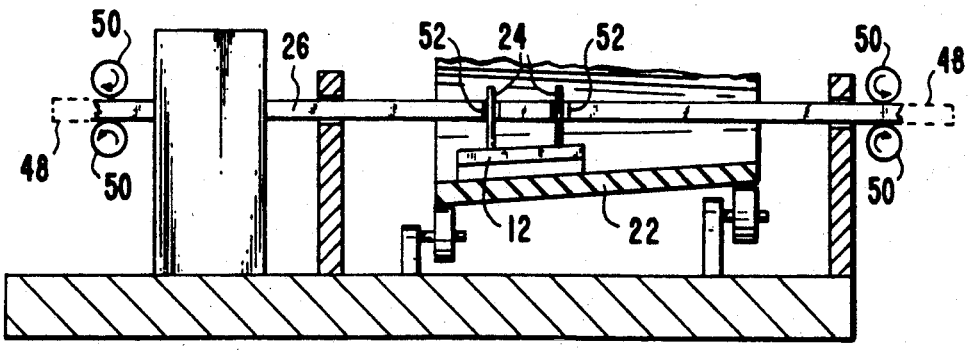

APPARATUS FOR FINISHING A CONIC SURFACE

This is a continuation of application Ser. No. 07/698,422 filed May 10, 1991.

BACKGROUND OF THE INVENTION

The present invention generally relates to an apparatus for finishing a conic surface and, in particular, relates to one such apparatus having rigid members defining planes that, intersect in a line collinear with the axis of the conic surface.

It is known that conventional surfaces requiring near normal incident angles are quite inefficient for optical purposes when the incident radiation of interest is in the ultraviolet or X-ray regions of the electromagnetic spectrum. This inefficiency is attributed to the poor reflectivity of conventional surfaces at these spectral regions. Consequently, when operating in the ultraviolet or X-ray region grazing incidence optical systems are employed.

One particularly efficient surface commonly used for grazing incidence optical systems is a conic surface having a longitudinal axis. One major difficulty of fabricating such a surface is the efficient grinding and polishing, i.e., finishing, thereof. Conventionally, a typical finishing tool is a substantially rigid rectangular block of material having a contact face that is curved to approximate the shape of the conic surface.

Such a tool, however, is quite inefficient because a conic surface has both a longitudinally changing radius of curvature and a transversely changing radius of curvature. Such compound changes of radii of curvature prevent the efficient rotation of such a tool against the optical surface during finishing. Further, if such a tool is moved longitudinally, or parallel, to the optical axis, the change of radius of curvature causes a misfit between the tool and the surface being finished.

One approach to resolving this problem has been to finish such an optic using a long but very narrow tool. While such a scheme does maintain a better fit of the tool to the surface, the tool must be quite narrow. The use of a narrow tool generally greatly increases the time needed for finishing a grazing incident optic since the material removal of a finishing tool is dependent on the surface contact area between the tool and the surface. Further, with a long narrow tool the changing longitudinal diameter of the optic restricts the maximum excursion of the tool. This restriction further reduces the material removal rate.

Consequently, there is a substantial need and desire for an apparatus for finishing a conic surface that enables both full rotational finishing and extended excursion finishing.

SUMMARY OF THE INVENTION

Accordingly, this object is accomplished, at least in part, by an apparatus having rigid members affixed to a flexible finishing member and disposed such that the planes defined by the rigid members intersect in a line coincident with the longitudinal axis of the conic surface.

Other objects and advantages of the present invention will become apparent to those skilled in the art from the following detailed description read in conjunction with the appended claims and the drawings attached hereto.

BRIEF DESCRIPTION OF THE DRAWINGS

The drawing, not drawn to scale, includes:

FIG. 1 is a perspective view of an apparatus embodying the principles of the present invention;

FIG. 3 is a side view of the system shown in FIG. 2 taken along the line 3—3 thereof;

FIG. 4 is a top sectional cut-a-way of the system shown in FIG. 2; and

DETAILED DESCRIPTION OF INVENTION

Figures 2, 5:
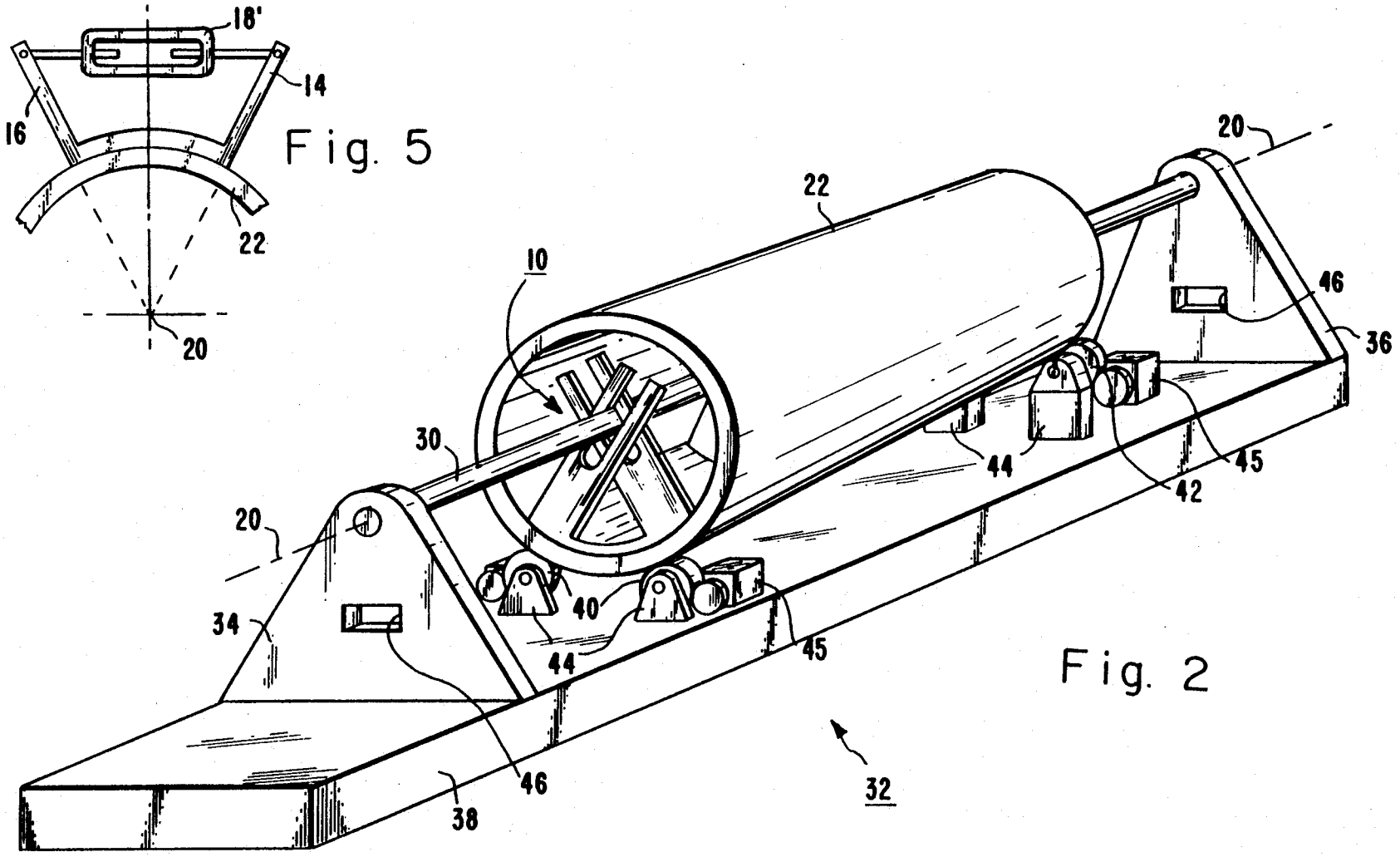
FIG. 2 is a perspective view of a system for finishing a conic surface embodying the principles of the present invention.
FIG. 5 is a perspective view of another apparatus embodying the principles of the present invention.

An apparatus for finishing a conic surface, generally indicated at 10 in FIG. 1, includes a flexible base member 12 having first and second rigid members, 14 and 16, respectively, affixed thereto. The first and second rigid members, 14 and 16, respectively, defining first and second planes. The apparatus 10 further includes means 18 for retaining the first and second rigid members 14 and 16, respectively such that the planes defined thereby intersect collinearly with the axis 20 of the conic surface 22, shown in FIG. 2, to be finished.

The apparatus 10 can further include at least one pin member 24 disposed to engage a translation member 26, shown in FIGS. 3 and 4. As more fully discussed hereinafter the pin member 24, serves to permit movement of the base member 12 transverse to the translation member 26 during operation.

In one embodiment, although not to be deemed a limitation, the base member 12 is generally trapezoidal in its planar unflexed state having the parallel sides thereof of such length as to match the change of radius of the conic surface 22 to be finished. As another alternative, the base member 12 may be generally triangular in its planar unflexed state. The first and second rigid members, 14 and 16, respectively, are affixed to the base member 12 and, in one embodiment, include slots 28 extending thereinto to enable engagement with an axial member 30.

In the preferred embodiment the first and second rigid members, 14 and 16, respectively, each include a plurality of finger members that are disposed on opposing sides or side edges of the base member 12 such that they are interdigitated when the base member 12 is flexed to have the planes defined thereby intersect in a line that is collinear with the axis of the conic surface 22.

In one specific embodiment, the flexible base member 12 can be fabricated from commercially available flexible materials and is, for example, on the order of about $\frac{1}{8}$ to $\frac{1}{2}$ inches thick. In conjunction with the inherent material properties the flexibility of the apparatus 10 is determined by the thickness of the material. Typically, the larger the surface area desired for the base member 12 the thinner the base member 12 will be made. The first and second rigid members, 14 and 16, respectively, can be commercially available materials, including metals and plastics affixed to the base member 12 by either epoxy or screws or such other means as desired.

In a system 32, shown in FIG. 2, wherein the apparatus 10 is particularly useful, the means 18 includes the axial member 30 disposed in and positioned by first and second axial member supports, 34 and 36, respectively, disposed on a platform 38. The conic optic 22 is, in one embodiment, disposed on first and second pairs of rollers, 40 and 42, respectively. The pairs of rollers, 40 and 42, both support and rotate the conic optic 22 being finished. In a typical system 32, the pairs of rollers, 40 and 42, are rotatably connected to a drive means 45. The pairs of rollers, 40 and 42, are mounted on roller mount members 44 having heights adapted to the conic optic 22 being finished to ensure that the center line 20, i.e., the axis of rotation, thereof is substantially parallel to the plane of the platform 38.

The axial member 30 is disposed along the axis 20 of the conic optic 22 being finished and the apparatus 10 is disposed within the optic 22 with the first and second rigid members, 14 and 16, respectively, being secured by, in one embodiment, the slots 28 to the axial member 30. Such an arrangement ensures that the planes of the first and second rigid members, 14 and 16, respectively, intersect in a line that is collinear with the axis 20 of the optic 22 being finished.

In the preferred embodiment, the bar support members, 34 and 36, each have an opening 46 through which the translation member 26 extends. The translation member 26, in this embodiment, extends through the opening 46 in each support member 34 and 36, and, as shown in FIGS. 3 and 4, is affixed to the pin members 24 extending from the base members 12 of the apparatus 10. In one embodiment, the translation member 26 extends beyond the openings 46 in the support members, 34 and 36, and each end, 48 thereof is captured by motorized pinch rollers 50. Hence, in operation, the finishing of the conic surface 22 occurs by the pinch rollers 50 being alternately rotated to thereby impart an alternating pull force in opposite directions to the translation member 26. Thus, the apparatus 10 is operated with a pull-pull motion as opposed to a push-pull motion and thus the flexible base member 12 contacts the conic surface 22 throughout the entire length of the optic 22. Further, the pull-pull motion occurs while the optic 22 is being rotated thus ensuring that the entire inner conic surface 22 is finished.

It is understood that an appropriate slurry and grit material is disposed between the apparatus 10 and the surface 22 being polished during the finishing process.

The translation member 26 is more clearly shown in FIG. 3 which is a side view of the system 32 shown in FIG. 2. As shown therein, the apparatus 10 includes first and second pins members 24 that extend through pin clearance openings 52 in the translation member 26 that allow not only the pull-pull finishing motion to be imparted to the base member 12 in the longitudinal direction but also permits the apparatus 10 to move transversely with respect thereto. Hence, the finishing surface of the flexible base member 12 of the apparatus 10 is in contact with the conic surface 22 being polished at all times. Thus, the grinding and polishing operation is more efficient.

With reference to FIG. 4 a general top view is shown to further clearly depict how that translation member 26 and the apparatus 10 interact by means of the first and second pin members 24 extending from the apparatus 10 through the translation member 26. The translation member 26 is moved longitudinally by conventional pinch rollers 50 or other reciprocating means.

It will be understood that although the present apparatus and system have been described with respect to the finishing of an interior conic surface the same apparatus based on the same principles, i.e., the intersection of the planes defined by the rigid members being floats with the axis of the optic being polished, can be used, as shown in FIG. 5, to finish exterior conic surfaces. As shown in FIG. 5 the cone-like surface 22 to be finished is an exterior surface. The planes defined by the first and second rigid members, 14 and 16, respectively, are shown as dashed lines and intersect along a line collinear with the axis 20 of the conic surface 22. In such an embodiment, the means 18 for retaining the rigid members, 14 and 16, in proper position can be, for example, a computer controlled turn-buckle secured to the rigid members 14 and 16.

Although the present invention has been described herein with respect to specific embodiments it will be understood that other configurations and arrangements may also be employed which do not depart from the spirit and scope of the present invention. Hence the present invention is deemed limited only by the appended claims and the reasonable interpretation thereof.

What is claimed is:

1. Apparatus for finishing a conic surface having an axis associated therewith, said apparatus comprises:

first and second rigid members, said first and second rigid members defining first and second planes;

a flexible member, said flexible member having a first major surface, said first and second rigid members being affixed to said flexible member substantially perpendicularly to said first major surface thereof, said major surface defining a planar geometric shape that, when said planes of said rigid members intersect in a line collinear with said axis, closely approximates said comic surface;

means for retaining said rigid members such that said planes defined thereby intersect collinearly with said axis of said conic surface and;

means for transversely guiding said flexible base member such that when said flexible member is moved along and maintained contact with said conic surface said intersection of said planes remains collinear with said axis along the entire length of said axis.

2. Apparatus as claimed in claim 1, wherein said planar geometric shape is trapezoidal and said first and second rigid members are disposed along the nonparallel edges thereof.

3. Apparatus as claimed in claim 1 wherein said planar geometric shape is triangular.

4. Apparatus as claimed in claim 1, wherein said first rigid member includes a plurality of first finger members and said second rigid member includes a plurality of second finger members, said first and second finger members being disposed such that they interdigitate.

5. Apparatus as claimed in claim 4, wherein each said first and second finger member includes a slot extending thereinto from the end thereof distal said flexible member.

6. Apparatus as claimed in claim 5, wherein said retaining means includes:

an axial member disposed along the axis of said conic surface, said axial member being disposed in said slots such that said rigid members intersect along said axis of said conic surface.

7. Apparatus as claimed in claim 1, wherein said transverse guide means includes at least one pin member extending from said flexible base member.

8. Apparatus as claimed in claim 7, wherein said transverse guide means further includes a longitudinal translation member having guide pin openings therein for receiving said at least one pin member.

9. A system for finishing a conic surface having an axis associated therewith, said system comprises:

means for rotating said conic surface about said axis;

means, in contact with a portion of said cone-like surface, for finishing said conic surface, said finishing means including first and second rigid members defining first and second planes, a flexible member having a first major surface, said first and second rigid members being affixed to said flexible member substantially perpendicularly to said first major surface;

means for translating said conic surface finishing means in a direction parallel with said axis thereof;

means for retaining said rigid members such that when the finishing means is moved along and maintained contact with the conic surface, said planes defined thereby inherently and said intersection remains collinear intersect with said axis of said cone-like surface throughout said translation.

10. The system as claimed in claim 9 wherein said rotating means includes:

first and second pairs of rollers, said pair of rollers being disposed to support said conic surface such that said axis thereof is substantially horizontal; and means, associated with at least one roller from each of said pairs of rollers to rotate such that said conic surface is rotated.

11. The system as claimed in claim 9 further comprises:

means, affixed to said conic finishing means, for interconnecting with said translation means such that said finishing means maintains contact with said conic surface.

12. The system as claimed in claim 11 wherein said interconnection means includes:

at least one pin member affixed to said finishing means and extending therefrom toward said axis of said conic surface; and means, integral with said translation means, for receiving said at least one pin member such that said finishing means can move transversely thereto.

* * * * *